United States Patent [19]

Gazzola

[11] Patent Number: 5,027,874

[45] Date of Patent: Jul. 2, 1991

[54] HANDBAG OR THE LIKE WITH A HANDLE WHICH CAN BE CONVERTED INTO A SHOULDER STRAP

[75] Inventor: Giovanni A. Gazzola, Rome, Italy

[73] Assignee: Lucas International S.r.1., Bologna, Italy

[21] Appl. No.: 487,079

[22] Filed: Mar. 1, 1990

[30] Foreign Application Priority Data

Mar. 3, 1989 [IT] Italy ..... 3561489[U]

[51] Int. Cl.[5] ..... A45C 3/06; A45C 13/28; A45C 13/30

[52] U.S. Cl. ..... 150/108; 150/107; 190/115; 224/162

[58] Field of Search ..... 150/108; 190/18 A, 115; 224/162; 242/107.7, 129.3, 147

[56] References Cited

U.S. PATENT DOCUMENTS

| | | | |
|---|---|---|---|
| 811,215 | 1/1906 | Goldsmith | 150/108 |
| 1,213,758 | 1/1917 | Delaney | 242/107.7 X |
| 1,468,711 | 9/1923 | Dwyer | 150/108 X |
| 1,559,092 | 10/1925 | Hallberg | 242/107.7 |
| 1,979,978 | 11/1934 | Martin | 190/115 |
| 2,769,475 | 11/1956 | Fisher | 150/108 X |
| 2,960,137 | 11/1960 | Lipsitz | 150/108 X |
| 3,198,300 | 8/1965 | Tuttle | 224/162 X |
| 3,982,613 | 9/1976 | Wood | 190/18 A X |
| 4,508,202 | 4/1985 | Siegert et al. | 190/18 A X |
| 4,763,763 | 8/1988 | Sadow | 150/108 X |

FOREIGN PATENT DOCUMENTS

| | | | |
|---|---|---|---|
| 1028376 | 5/1953 | France | 224/162 |
| 401381 | 4/1966 | Switzerland | 224/162 |
| 626278 | 7/1949 | United Kingdom | 150/102 |

*Primary Examiner*—Sue A. Weaver
*Attorney, Agent, or Firm*—Sughrue, Mion, Zinn Macpeak & Seas

[57] ABSTRACT

A handbag with a handle which can be converted into a shoulder strap includes a flexible strap a portion of which extends from an upper portion of the body of the handbag and constitutes its handle. The handbag includes a device for adjusting the length of the portion of the strap outside the upper portion of the body of the handbag so that the handle can be converted into a shoulder strap.

8 Claims, 3 Drawing Sheets

HANDBAG OR THE LIKE WITH A HANDLE WHICH CAN BE CONVERTED INTO A SHOULDER STRAP

The present invention relates to a handbag or the like having a body with a handle at the top.

Handbags and similar articles having a shoulder strap which may be adjustable in length, as well as a handle, are known. The shoulder strap enables the handbag to be carried more easily but constitutes an unnecessary encumbrance when the handbag is carried by the handle.

In order to resolve this problem, the subject of the present invention is a handbag or the like, characterized in that it includes a flexible strap arranged inside an upper portion of the body from which a portion of the strap connected to the handle extends, and in that it includes a device for adjusting the length of the portion of the strap which extends out of the upper portion of the body, the adjustment device being provided with resilient means which tend to return the strap to the upper portion of the body.

By virtue of this characteristic, the handle which is normally gripped in order to carry the handbag by hand can be converted quickly into a shoulder strap whose length can be adjusted at will according to the requirements of the user.

In the present description and in the claims which follow, the term "handbag or the like" refers to any article for transporting objects, documents, etc., such as, for example, handbags, briefcases, suitcases, etc.

Figure 1:
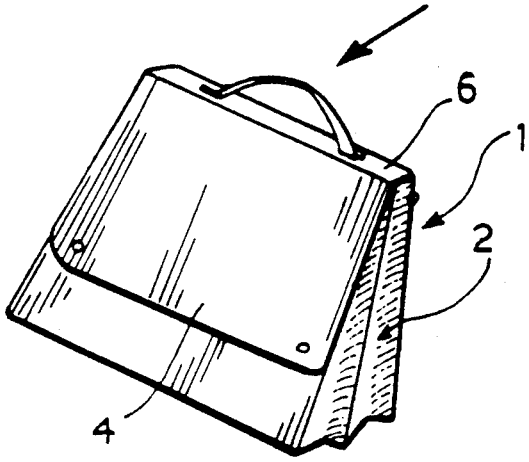
Figure 2:
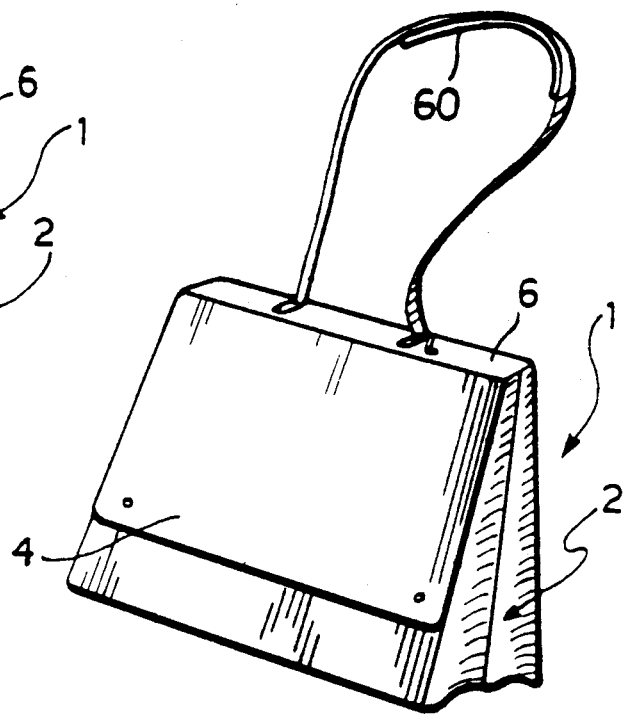
Figure 5:
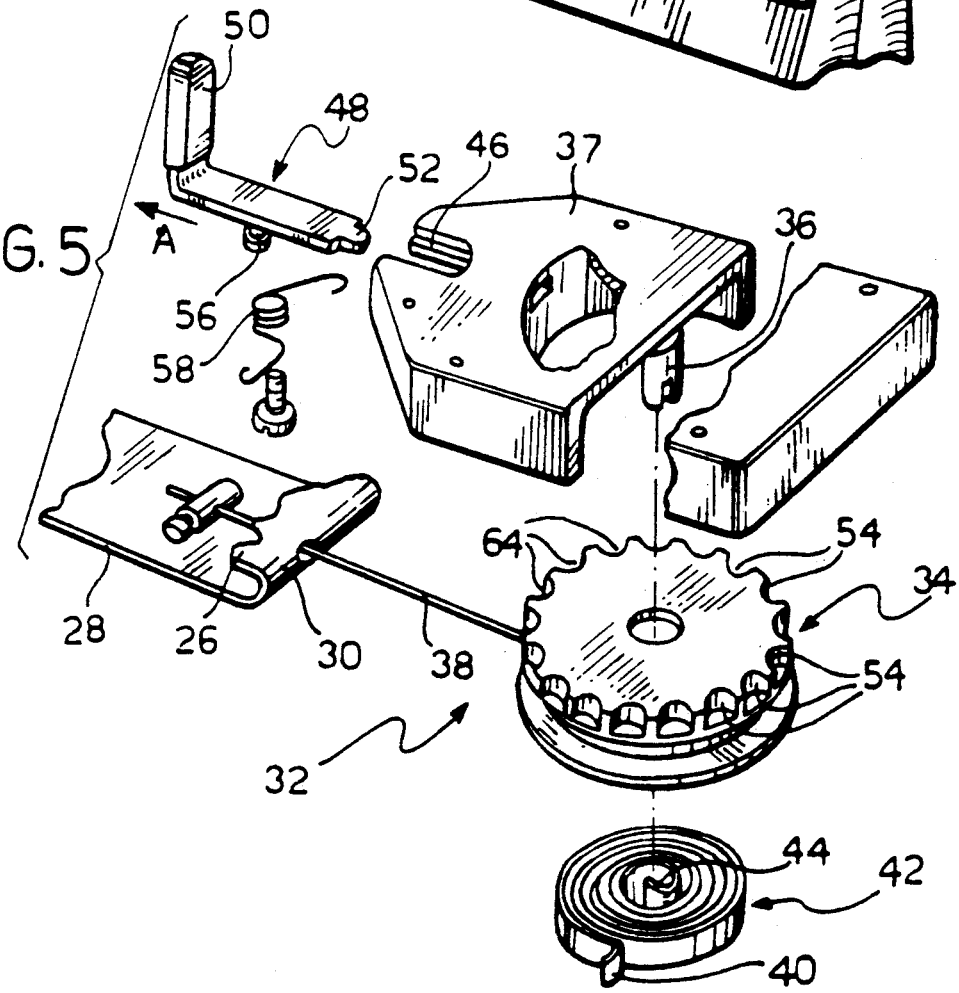
Figure 3:
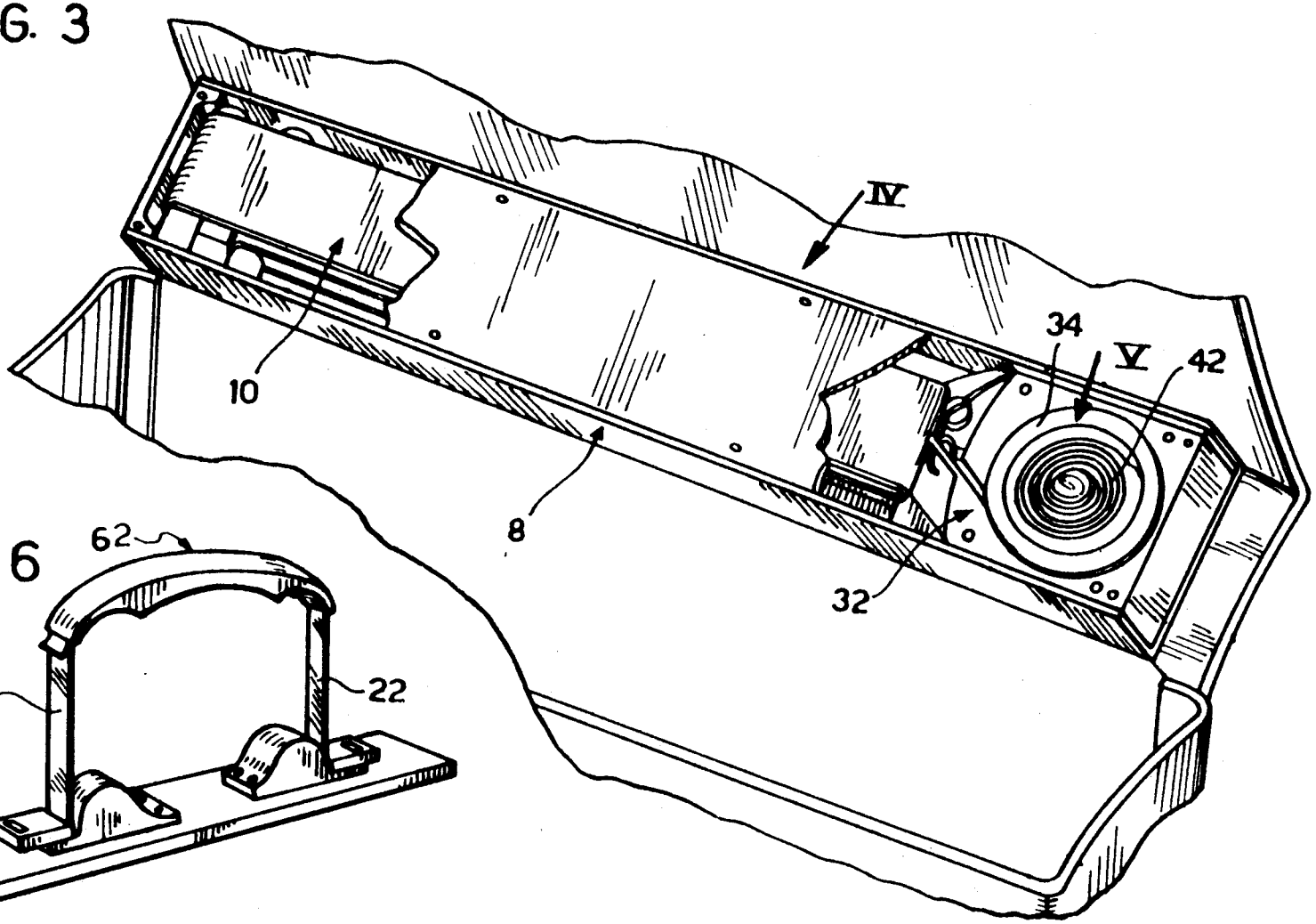
Figure 6:
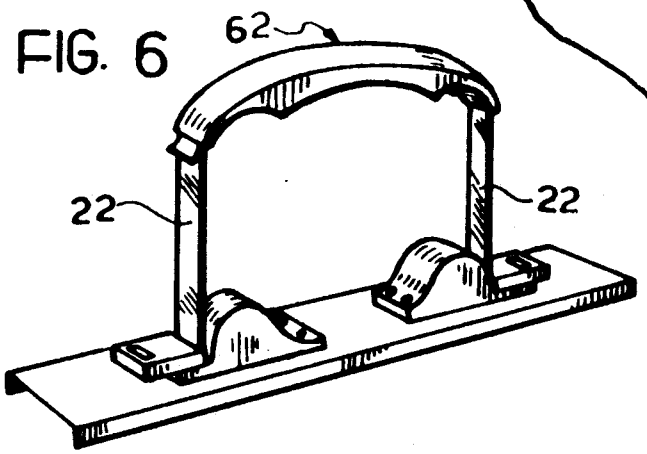
Figure 4:
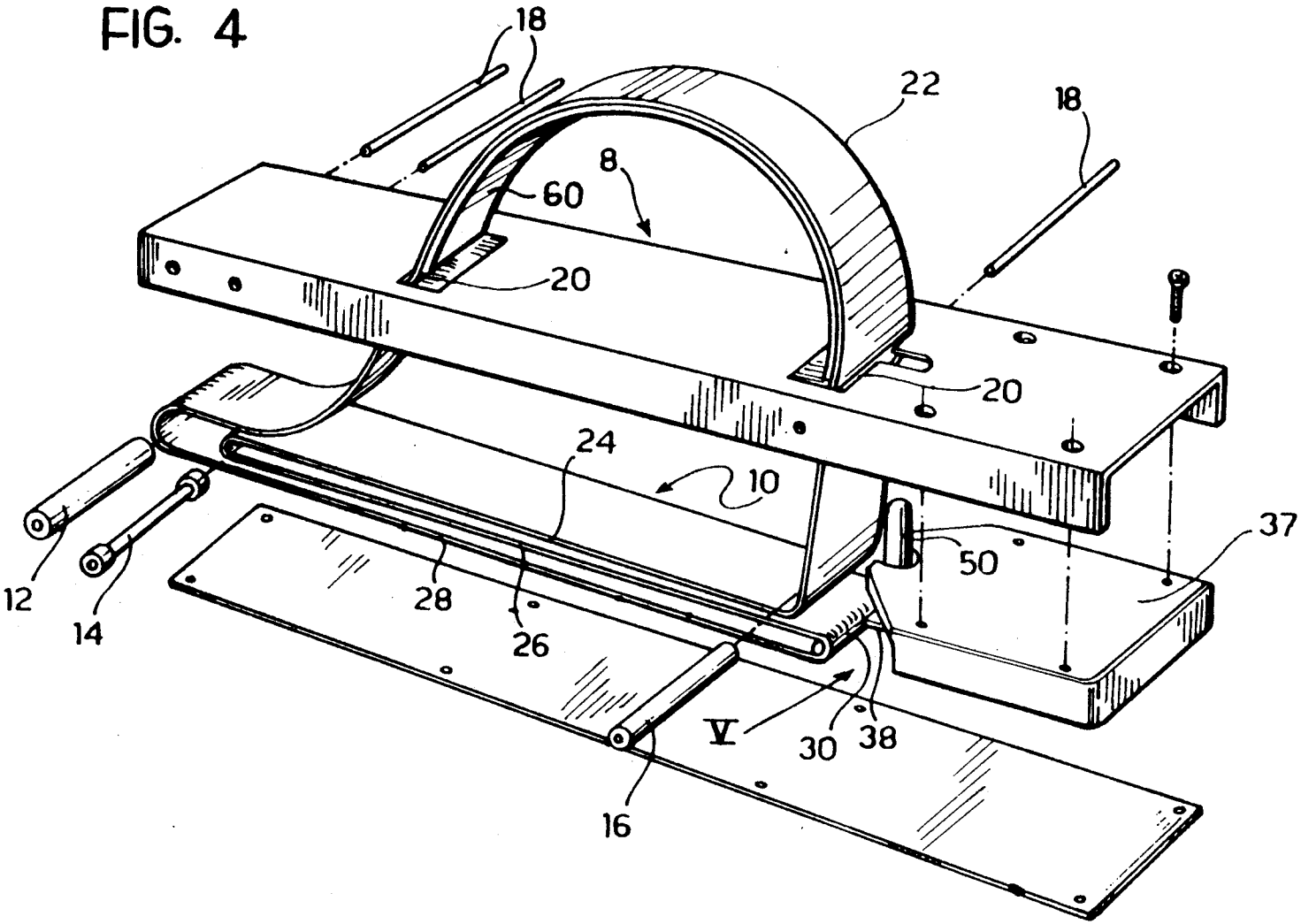

The present invention will now be described in detail with reference to the appended drawings, provided purely by way of non-limiting example, in which:

FIGS. 1 and 2 are perspective views of a handbag in different configurations of use, FIG. 3 is a partially-sectioned perspective view of the inside of the handbag shown in FIGS. 1 and 2, FIG. 4 is an exploded perspective view of the part indicated by the arrow IV in FIG. 3, FIG. 5 is an exploded perspective view of the part indicated by the arrows V in FIGS. 3 and 4, FIG. 6 is a perspective view showing a variant of the part indicated by the arrow VI in FIG. 1.

With reference to the drawings, a handbag, indicated 1, is constituted by a body 2 having a front portion 4 which can be opened and an upper portion 6.

As can be seen in FIG. 3, a rigid casing 8 is fixed to the upper portion 6 of the body 2 and a flexible strap 10 is situated therein. As shown in FIG. 4, the casing 8 carries three return rollers, indicated 12, 14 and 16, which are rotatable about respective pins 18 carried by the side walls of the casing 8. The portion of the strap between the rollers 12 and 16 extends out of the casing 8 and out of the upper portion 6 of the body 2 through a pair of slots 20. The portion cf the strap, indicated 22, which is outside the upper portion 6 of the body 2 constitutes the handle or the shoulder strap of the handbag 1. Still with reference to FIG. 4, a first portion 24 of the strap 10 is situated between the rollers 14 and 16 whilst a second portion 26 and a third portion 28 are situated between the rollers 14 and 16 and between the rollers 12 and 16, respectively. The first portion 24 is situated between two rollers with fixed axes and therefore has a constant length whilst the lengths of the portions 26 and 28 can be varied, as will be explained further below, to compensate for the variation in the length of the portion 22 of the strap which extends out of the upper portion 6 of the body 2. The ends of the portions 26 and 28 are interconnected at 30 and are connected to a return device 32 for adjusting the length of the portion 22 of the strap outside the upper portion 6 of the body 2 (FIG. 5).

As can be seen in greater detail in FIG. 5, the adjustment device 32 includes a sprocket 34 which is freely rotatable on a pin 36 carried by a housing 37 fixed to the casing 8. A wire 38 is wound round the sprocket 34 and one of its ends is anchored to the ends 30 of the portions 26, 28 of the strap 10. The outer end 40 of a spiral spring 42 is fixed to the sprocket 34 with its inner end 44 fixed to the Pin 36. An L-shaped stop member is slidable in a seat 46 in the housing 37 and has an arm 50 which projects from the casing 8 and the upper portion 6 of the body 2. An end 52 of the stop member 48 cooperates with a plurality of notches 54 around the periphery of the sprocket 34. The stop member 48 has an appendage 56 which is acted upon by a spring 58 that tends to urge the stop member 48 towards a position in which the end 52 of the member 48 engages one of the notches 54 of the sprocket 34.

A reinforcing element 60 is fixed to a central part of the portion 22 of the strap and its thickness is such that the overall thickness of the strap 10 and the reinforcing element 60 is greater than the width of each slot 20 in order to prevent the whole of the strap 10 from being retracted by the device 32 and the portion 22 from being flattened against the upper portion 6 of the body 2.

FIG. 6 shows a variant in which the portion of the strap outside the upper portion 6 cf the body 2 is fixed to a handle 62 of semi-rigid plastics material (for example polyurethane).

The device described above operates as follows. Starting from the configuration shown in FIG. 1, in order to increase the length of the portion 22 of the strap, the user acts manually on the portion 50 of the stop member 48 to cause the latter to slide in the direction indicated by the arrow A in FIG. 5. The stop member 48 releases the sprocket 34 which is therefore free to rotate about the pin 36. The user simultaneously pulls the portion 22 of the strap against the return action of the spring 42. A decrease in the lengths of the portions 26 and 28 and the unwinding of the wire 38 from the sprocket 34 compensate for the increase in the length of the portion 22. When the portion 22 has reached the required length, the user releases the stop member 48 which returns under the action of the spring 58 to the condition in which it engages a notch 54 of the sprocket 34. In order to shorten the portion 22 of the strap, it suffices to push the stop member 48 in the direction indicated by the arrow A to release the sprocket 34 which rotates under the action of the spring 42 and returns the strap 10 to the configuration shown in FIG. 1.

What is claimed is:

1. A handbag comprising a body, a flexible strap arranged inside an upper portion of the body and having a portion extending outwardly from the upper portion of the body and adjustment means for adjusting the length of the portion of the strap outside the upper portion of the body, said adjustment means comprising resilient return means mounted in said upper portion of said body and at least three rollers rotatably mounted in said upper portion of said body in spaced apart, parallel relation to each other, said flexible strap inside said upper portion extending about said rollers to define a first straight portion of constant length and second and third straight portions of variable length disposed parallel to each other and said first straight portion with adjacent ends of said second and third straight portions being connected to said resilient return means which normally tends to return said portion of said strap outside said upper portion of said body into said upper portion and stop means operatively connected to said resilient return means for retaining said strap in a configuration which corresponds to a desired length of the portion of the strap outside the upper portion of the body.

2. A handbag as set forth in claim 1, wherein said resilient return means includes a sprocket having a wire wound thereon with one end of the wire connected to said sprocket and an opposite end of the wire connected to said adjacent ends of said second and third straight portions of said strap.

3. A handbag according to claim 2, further comprising a pin mounted in said upper portion of said body with said sprocket being rotatably mounted thereon and wherein said resilient means includes a spiral spring having one end fixed to said sprocket and an opposite end fixed to said pin.

4. A handbag according to claim 2, wherein said stop means comprises a plurality of notches formed on said sprocket, a stop member having an end adapted to engage one of said notches and support means slidably mounting said stop member in said upper portion of said body for sliding movement of said stop member into and out of engagement with a selected one of said notches.

5. A handbag according to claim 4, wherein a resilient element engages said stop member and urges said stop member into engagement with one of said notches of said sprocket.

6. A handbag according to claim 5, wherein said stop member has an L-shaped configuration with an arm which projects from the upper portion of the body.

7. A handbag according to claim 1, wherein the upper portion of the body defines a pair of slots through which the strap extends, and wherein a reinforcing element is fixed to a central portion of the strap and is of a thickness such that the overall thickness of the strap and the reinforcing element is greater than the width of each slot.

8. A handbag according to claim 1, wherein a handle is fixed to the portion of the strap outside the upper portion of the body.

* * * * *